United States Patent [19]

Kappeler et al.

[11] Patent Number: 4,970,842

[45] Date of Patent: Nov. 20, 1990

[54] AIR BARRIER SEALING DEVICE

[76] Inventors: Gerhard O. Kappeler, 10 Duke Street, Conestogo, Ontario, Canada, N0B 1N0; Bruce D. Shorney, 22 Covington Crescent, Kitchener, Ontario, Canada, N2N 2W6

[21] Appl. No.: 160,878

[22] Filed: Feb. 26, 1988

[30] Foreign Application Priority Data

Feb. 2, 1988 [CA] Canada ..... 557908

[51] Int. Cl.[5] ..... E04B 1/00

[52] U.S. Cl. ..... 52/741; 52/412; 52/565; 52/712

[58] Field of Search ..... 52/222, 410, 412, 562, 52/565, 249, 384, 385, 712, 379, 741, 746, 747, 169.14

[56] References Cited

U.S. PATENT DOCUMENTS

| | | | |
|---|---|---|---|
| 1,959,176 | 5/1934 | Rau . | |
| 3,772,840 | 11/1973 | Hala | 52/410 X |
| 3,793,795 | 2/1974 | Annand . | |
| 3,848,380 | 11/1974 | Assael . | |
| 3,895,468 | 7/1975 | Bernstein . | |
| 3,909,994 | 10/1975 | Richter | 52/222 X |
| 4,112,643 | 9/1978 | Decker | 52/222 |
| 4,149,349 | 4/1979 | Nilsen et al. | 52/712 X |
| 4,164,105 | 8/1979 | Herbst . | |
| 4,193,235 | 3/1980 | Cucchiara | 52/222 X |
| 4,233,790 | 11/1980 | Meadows . | |
| 4,240,233 | 12/1980 | Vercelletto | 52/565 X |
| 4,502,256 | 3/1985 | Hahn . | |
| 4,566,236 | 1/1986 | Pound . | |
| 4,610,120 | 9/1986 | Canavesi et al. | 52/169.14 X |
| 4,617,771 | 10/1986 | Tomaszewski | 52/410 |
| 4,665,670 | 5/1987 | van den Burg | 52/222 |
| 4,694,543 | 9/1987 | Conley | 52/222 X |
| 4,698,947 | 10/1987 | McKay | 52/562 X |
| 4,825,614 | 5/1989 | Bennett et al. | 52/712 X |

*Primary Examiner*—David A. Scherbel
*Assistant Examiner*—Lan Mai
*Attorney, Agent, or Firm*—Rogers, Bereskin & Parr

[57] ABSTRACT

A sealing device is provided for sealing an air barrier membrane to a wall, particularly to a wall having masonry tie anchors projecting outwardly therefrom. The device includes a flat pre-formed member which can engage sealingly to the masonry tie anchors and which has surface means for sealingly securing the air barrier membrane thereto.

20 Claims, 5 Drawing Sheets

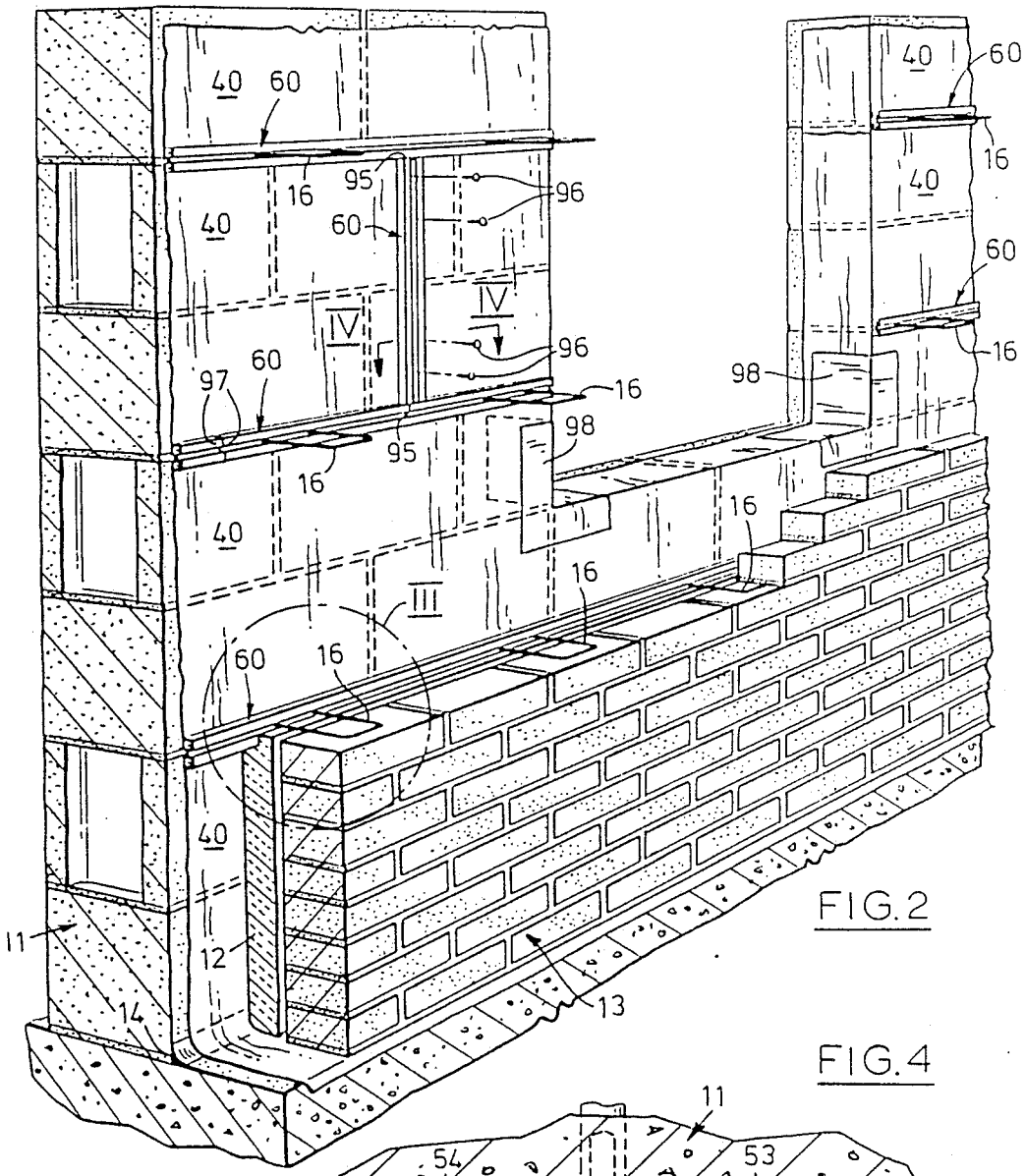
FIG. 2
FIG. 4
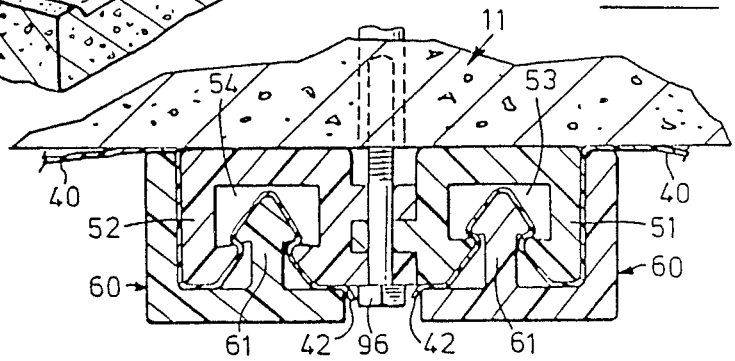

AIR BARRIER SEALING DEVICE

BACKGROUND OF THE INVENTION

This invention relates generally to a sealing device for sealing an air barrier membrane to a wall, particularly to a wall having projecting tie rods.

A typical two wythe cavity wall comprises a first wythe of poured concrete or concrete blocks or steel or wooden studs or so forth, and a second wythe of a facing material, such as brick, block or stone. Generally, insulation material is attached to the inner wythe but a cavity is left between the insulation and the facing material. This is to permit water leakage to drain away. Many facing materials, such as brick, are quite pourous. During a heavy summer rain moisture can readily penetrate through such a facing. This moisture though is not particularly problematic, since it simply runs down the cavity and is re-directed back outside of the wall by means of flashing or so forth.

However, air and moisture can also penetrate from the interior of the building through the inner wythe. Many modern buildings are under positive internal pressure relative to the surrounding environment because of their ventilation systems. During winter, warm moist air from the interior of the building which penetrates through the inner wythe and the insulation into the cavity between the two wythes is quickly cooled, causing moisture to condense and ultimately freeze if the outside temperature is cold enough. Such air leakage has recently become recognized as a major factor in determining building performance or serviceability. It results in excessive efflorescence, spalling, and displacement of facing material.

Accordingly, it has recently been proposed that buildings of this type of construction have a completely sealed air barrier to prevent any leakage of air from the interior of the building through the inner wythe into the cavity between the insulation and the outer wythe of facing material. In fact, some jurisdictions have adopted regulations requiring the installation of such barriers. At present, two basic types of air barriers are in use. First there are sheet membranes, which generally comprise a layer of bitumen or similar material on a sheet reinforcement, for example polyethylene sheet. These may be adhered to the outer surface of the concrete wythe with an appropriate adhesive or in some cases they are heat fused to the concrete. Second, there are semi-liquid applied membranes, which essentially comprise viscous bitumen or similar material which may be trowelled onto the surface of the concrete, or sometimes sprayed.

In two wythe construction, the facing wythe is secured to the inner wythe generally by means of masonry ties. Masonry ties come in a variety of forms. Essentially, they comprise an anchor which projects outwardly from the inner wythe and which can be secured to the outer wythe, and means for securing the anchor to the inner wythe. A common type of brick tie, for example, used with inner wythes of concrete block, comprises an elongate frame with rods extending outwardly therefrom, usually in loops, on one side at regular intervals. These ties are placed within the mortar between courses of blocks, typically between every second course, with the tie rods extending outwardly to be fitted within the mortar between corresponding courses of bricks.

With the known air barrier membranes, either the sheet membrane or the liquid applied membrane, considerable time and effort must be spent to try to obtain a good seal around the masonry tie anchors which extend outwardly from the inner wythe. Anchors such as the rods of the common brick tie described above are typically positioned every 16 inches and they thus represent a considerable obstacle. Failure to obtain a complete seal of the air barrier membrane around the tie anchors, even just some of them, severely limits the effectiveness of the air barrier.

It is an object of the present invention to obviate or mitigate this and other disadvantages.

SUMMARY OF THE INVENTION

In accordance with a first aspect of the present invention, there is provided a sealing device for sealing an air barrier membrane around masonry tie anchors. The sealing device includes at least one substantially flat pre-formed member which engages sealingly to the tie anchor. The member also has surface means for sealingly securing the air barrier membrane to it. Advantageously, the sealing device comprises two elongate members adapted to lock sealingly to each other fastened to a masonry tie, each member having a plurality of apertures which sealingly engage the anchors of the masonry tie. Most advantageously, each of the two members has an elongate channel adapted to receive a sheet membrane and the device also comprises inserts adapted to fit closely within such channels, sealingly securing the sheet membranes therein.

According to another aspect of this invention, there is provided a masonry tie having an integral sealing device as just described.

According to a further aspect of the invention, there is provided a method of applying an air barrier to a wall having projecting masonry tie anchors comprising the steps of first sealingly engaging a sealing device as described above to the tie anchors and subsequently sealingly securing sheet membranes to such sealing devices.

According to a further aspect of the invention, there is provided a method for constructing a masonry tie having an integral sealing device, as described above, comprising the steps of heating the tie anchors with an induced electric current, and then hot forming the sealing device around the tie anchors in a close fitting seal.

According to a further aspect of the invention, there is provided an air barrier assembly for a wall comprising pieces of sheet membrane, sealing devices, inserts, and means for fastening the sealing devices to the wall. The sealing devices each comprise an elongate member having at least one channel adapted to receive the sheet membrane. The inserts are adapted to fit closely within the channels of the sealing devices, sealingly securing the sheet membrane therein.

The sealing device of the present invention is preformed to fit sealingly around the projecting tie anchors. Thus, considerable time and effort can be saved at the construction site, and a good seal is ensured. Advantageously, the sealing device is manufactured and sold integral to the masonry tie. The seal around the tie anchors can in this way be formed and checked in a controlled factory environment, rather than at a construction site. The invention also facilitates the use of convenient large pieces of sheet membrane, reducing handling and application time, and adhesive backing is generally not required on the sheet membrane, lowering material costs

BRIEF DESCRIPTION OF THE DRAWINGS

In order that the invention may be more clearly understood reference will now be made to the accompanying drawings which illustrate preferred embodiments of the invention and in which:

FIG. 2 is a perspective view of a two wythe cavity wall, showing the use of the brick tie and integral sealing device of FIG. 1;

FIG. 4 is a detailed sectional plan view of a part of the wall of FIG. 2 taken through the plane indicated by line IV—IV;

DESCRIPTION OF THE PREFERRED EMBODIMENTS

Figure 1:
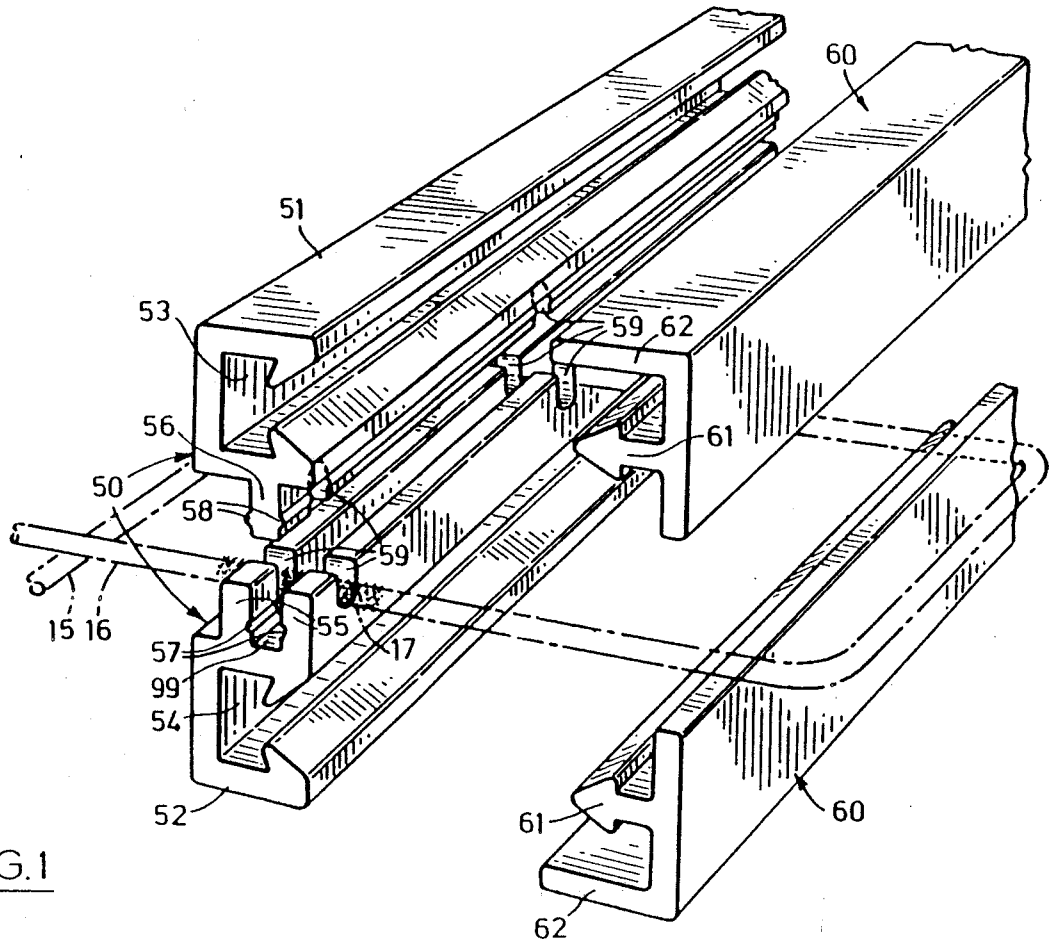
FIG. 1 is a detailed exploded perspective view of a first preferred embodiment of a sealing device of the present invention, the sealing device being shown in conjunction with a fragment of a brick tie (in ghosted outline) and being shown about two times the size which would be preferred, relative to the size of the brick tie, in order to reveal detail more clearly.
Figure 3:
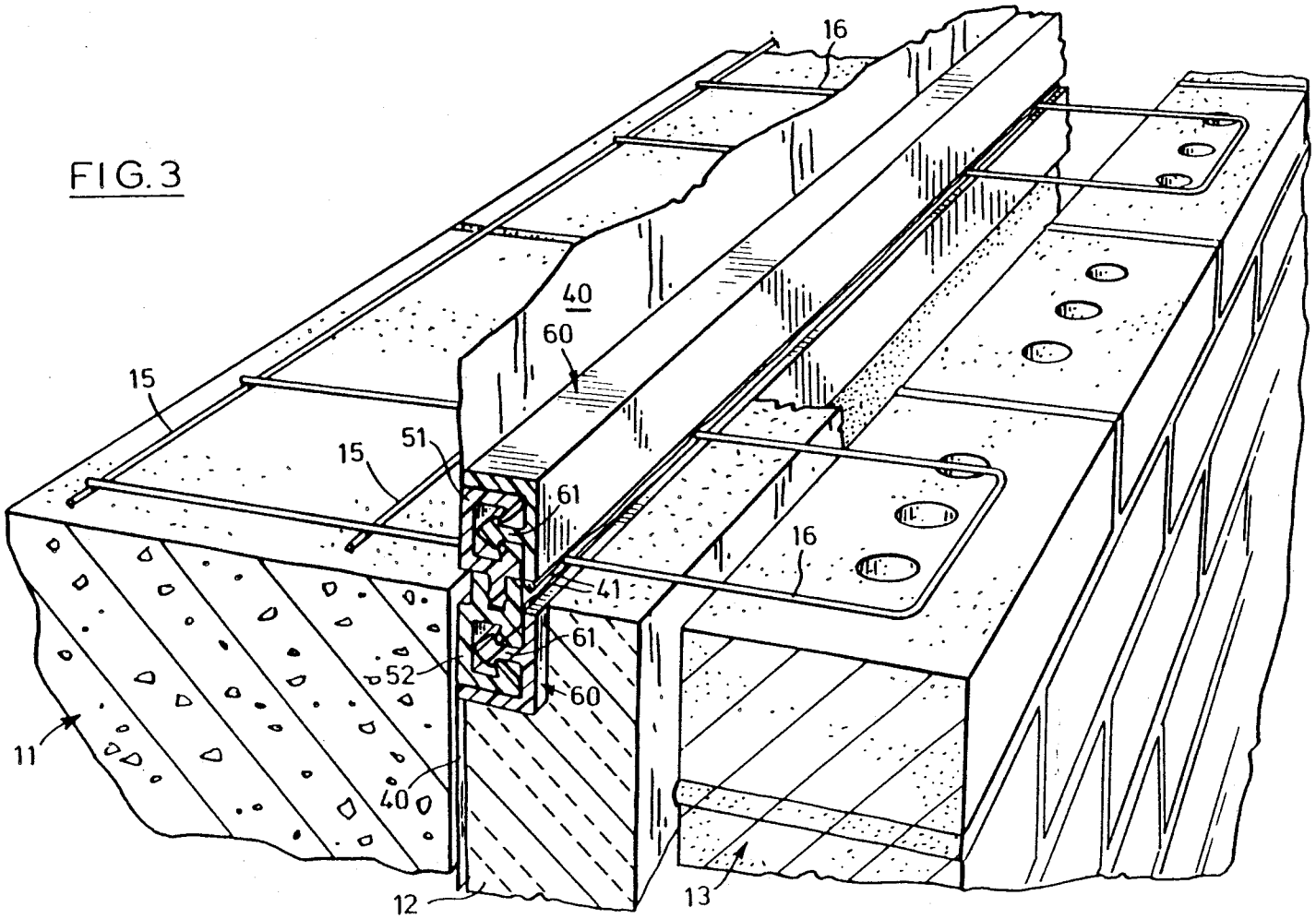
FIG. 3 is a detailed perspective view of a part of the wall of FIG. 2 indicated by the circle III.
Figure 5:
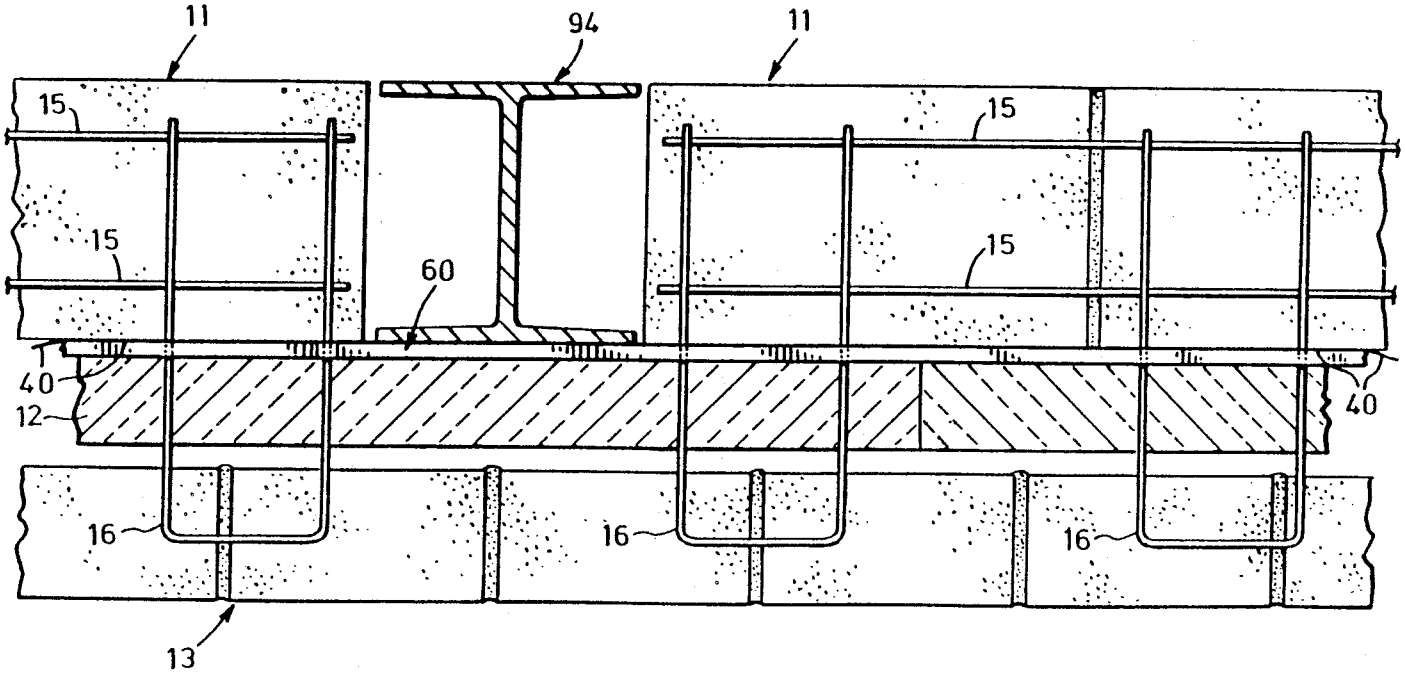
FIG. 5 is a schematic plan view of a two wythe cavity wall, showing the use of the brick tie of FIG. 2 around a structural column.

The sealing device shown in FIGS. 1 to 5, comprises a base strip 50 and insert strips 60. The base strip 50 comprises an upper member 51 and a lower member 52, both members being generally "C" shaped in section, having channels 53 and 54 respectively. The insert strips 60 are generally "F" shaped in section and have inserting projections 61 and wrap-around arms 62. The lower base member 52 has legs 55 which extend outwardly along a side wall and which form a groove 99 having recesses 57. The upper base member 51 has an elongate tongue 56 extending outwardly along one of its side walls and having raised portions 58. The components of the sealing device may be semi-rigid vinyl, PVC, or some other material which extrudes or can be moulded well and which has suitable properties of elasticity and imperviousness.

In use, the upper base member 51 and lower base member 52 are locked sealingly together, fastened upon and sealingly engaging brick tie rods 16. The upper base member 51 and lower base member 52 lock sealingly together with the tongue 56 of the upper base member 51 fitting into the groove 99 between the legs 55 of the lower base member 52, the raised portions 58 of the tongue 56 mating to the recesses 57 of the groove 99. The tongue 56 and the legs 55 have depressions 59 which together define a close fitting orifice surrounding the tie rod 16 when the upper base member 51 and lower base member 52 are locked together fastened to the brick tie. The tie rod 16 has knurling 17 to increase resistance to lateral sliding of the sealing device on the tie rods.

It has been found that in manufacturing a masonry tie having an integral sealing device, the sealing device may be effectively engaged to the tie rods 16 by heating the tie rods 16 with an induced electric current and hot forming the depressions 59 of the base strip 50 around the tie rods 16 in a close fitting seal while locking together the upper base member 51 and lower base member 52. According to this method, the tongue 56 and the legs 55 are extruded with continuous straight edges, that is without the depressions 59. The depressions 59 are formed only when the upper base member 51 and lower base member 52 are locked together on the heated tie rods. Alternatively, the base strip 50 may be pre-formed with the depressions 59 in its upper and lower members, 51 and 52 respectively, and then subsequently engaged sealingly to the brick tie 16 with a suitable adhesive. Manufactured brick tie with the integral sealing device may be assembled and sold in standard lengths, such as 10 foot lengths.

In installation, strips of sheet membrane 40 are placed in position between rows of brick ties having integral sealing devices, the edges 41 of the sheet membrane 40 being easily lapped over the sealing device base strips 50 and inserted into the channels 53 and 54. The insert strips 60 are then simply inserted to sealingly secure the edges 41 of the sheet membrane strips 40 within the channels 53 and 54 of the sealing devices. The wrap-around arms 62 hold the sheet membranes 40 in close engagement against the outer surface of the inner wythe 11. At floor level, the sheet membrane 40 is directed outward over a mastic cove 14 and under the insulation 12 and the outer wythe 13, using a wider strip of sheet membrane. At the top of the wall, a wider strip of sheet membrane is also used. The lower edge of this top strip is sealed in the top row of brick tie with integral device. The upper edge of the top strip of sheet membrane is lapped over the top of the inner wythe 11 and sealed with the roofing system.

The sheet membrane 40 may be vinyl, or polyethylene, or some other suitable impervious material. It may be made in rolled lengths of an appropriate width to fit between two consecutive rows of brick ties with integral sealing devices. Alternatively, it may be made in suitably sized rigid pieces. Vertical edges of the sheet membrane at ends of lengths 42 may be sealed with essentially the same sealing device, but for this use the sealing device is not mounted integrally to a brick tie. In this use, the base strip 50 of the sealing device is secured vertically to the inner wythe 11 between adjacent rows of brick ties using, for example, lag bolts 96 inserted and sealed in orifices the same or similar to those through which the tie rods 16 would ordinarily extend. This use demonstrates that such a sealing device can also be used to mount a sheet membrane air barrier to a wall which does not have projecting tie rods. A sealing device which is used to hold vertical edges 42 is also sealed at its ends 95 to the adjacent rows of brick tie sealing devices. Vertical edges 42 of sheet membrane 40 may alternatively be lapped and sealed with a suitable adhesive. A pre-formed membrane corner piece 98 is applied with adhesive at corners of window and door jambs and at bases of corners, where the membrane sheet 40 must be slit.

The integral sealing devices of adjacent lengths of brick ties are sealed together by applying suitable adhesive to abutting ends 97. At columns 94, the frame 15 of the brick tie is interrupted, but the sealing device may continue uncut bridging around the column. Alternatively, an insert segment of sealing device may be used to bridge around the column, secured to the inner wythe with, for example, lag bolts.

Figure 6:
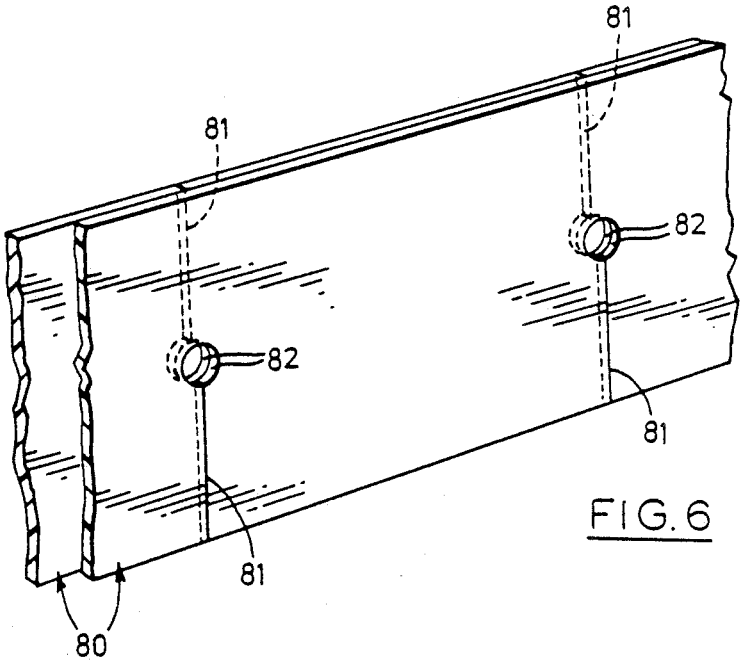
FIG. 6 is a perspective view of a second embodiment of a sealing device of the present invention.

In the embodiment of the invention shown in FIG. 6, the sealing device comprises two flat rubbery members 80, each having a plurality of slits 81 terminating in holes 82, which are adapted to receive and to fit closely around masonry tie rods. In use, the two members 80 are slipped over the masonry tie rods from opposing directions and then sealed together with adhesive or in some other manner. Sheet membrane may then be secured sealingly to outer portions of the outermost member 80, using adhesive or so forth, or liquid applied air barrier membrane may be trowelled or sprayed on and secured sealingly to outer regions of the outermost member 80, remote from holes 82.

Figure 7:
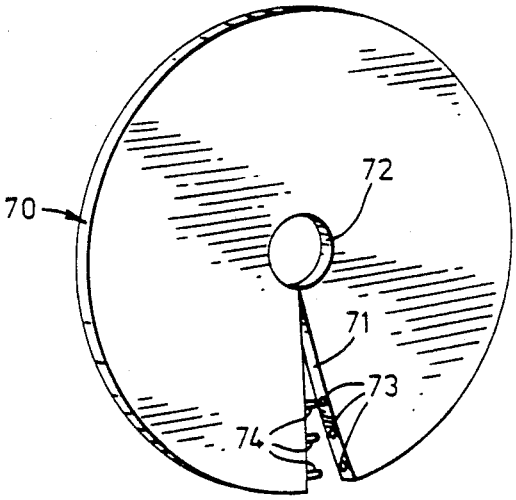

In the embodiment of the invention shown in FIG. 7, the sealing device comprises a single, substantially flat annular member 70, having a radial slit 71 terminating in a central hole 72, which is adapted to receive and to fit closely around a masonry tie rod. Opposing faces of slit 71 have orifices 73 and locking pins 74, respectively. In use, the member 70 is slipped over a masonry tie rod and then locked sealingly around the tie rod, with slit 71 being held closed by frictional retention of locking pins 74 in orifices 73. Air barrier membrane may then be secured sealingly to the outer annular portion of the member 70 using adhesive or so forth, as with the embodiments of FIG. 6.

It will of course be recognized that many variations are possible within the broad scope of the present invention.

I claim:

1. A method of applying an air barrier to a wall using anchors, comprising the steps of:

(a) positioning said anchors in alignment in said wall projecting outwardly from said wall; and (b) before or after step (a), sealingly engaging a pre-formed member to a plurality of consecutive aligned anchors such that said consecutive anchors extend transversely through said member, said member having surface means extending on both sides and between said consecutive anchors and also having means adapted for sealingly securing sheet membrane to said surface means on both sides of said consecutive anchors; and (c) after steps (a) and (b), sealingly securing air barrier sheet membrane to said surface means of said member on both sides of said consecutive anchors such that said membrane and said surface means form a continuously sealed air barrier with said consecutive anchors sealed thereto.

2. The method of claim 1, wherein step (b) is performed before step (a).

3. The method of claim 1, wherein the steps are repeated such that said sheet membrane and said surface means of such members form a continuously sealed air barrier over substantially all of said wall, with said anchors sealed to said air barrier.

4. The method of claim 1, wherein said anchors comprise tie anchors and wherein said sheet membrane comprises elongate strips of a width corresponding generally to the distance between adjacent rows of tie anchors.

5. A sealing device for sealing an air barrier membrane around the tie anchors of a masonry tie, said sealing device comprising at least one pre-formed member which has a plurality of apertures in spaced relationship adapted to engage sealingly to said tie anchors and which pre-formed member has surface means for sealingly securing said membrane to said member.

6. The device of claim 5, wherein said surface means for sealingly securing said membrane comprises a channel adapted to receive sheet membrane, and wherein said sealing device further comprises an insert adapted to fit closely within said channel, sealingly securing said sheet membrane therein.

7. The device of claim 6, wherein said sealing device comprises a first, upper portion and a second, lower portion adapted to lock sealingly to each other, fastened upon said masonry tie and sealingly engaging said tie anchors, each of said first and second portions having a channel adapted to receive sheet membrane, and wherein said sealing device further comprises two inserts adapted to fit closely within said channels, sealingly securing said sheet membrane therein.

8. A sealing device for sealing an air barrier sheet membrane around the tie rods of a masonry tie, comprising:

a first substantially flat, elongate member, being substantially "C[ shaped in cross section, having two side walls and a connecting wall, forming an open channel, and having two elongate projections along one of said side walls, forming a groove;

a second substantially flat, elongate member, being substantially "C" shaped in cross section, having two side walls and a connecting wall, forming an open channel, and having an elongate tongue extending outwardly along one of said side walls, adapted to lock sealingly within said groove of said first member, said tongue of said second member and said groove-forming projections of said first member being adapted to receive transversely and to engage sealingly the tie rods of a masonry tie;

and two elongate insert strips, being substantially "F" shaped in cross section having an insert projection adapted to fit closely within said channels of said first and second members such that an air barrier sheet membrane can be secured sealingly within said channels.

9. A masonry tie comprising a frame and a plurality of anchors projecting transversely outwardly from said frame, and having an integral sealing device for sealing an air barrier membrane around said anchors, said sealing device comprising at least one substantially flat, pre-formed member engaged sealingly to said anchors and having surface means for sealingly securing said membrane.

10. The masonry tie of claim 9 wherein said surface means for sealingly securing said membrane comprises a channel adapted to receive sheet membrane, and wherein said sealing device further comprises an insert adapted to fit closely within said channel, sealingly securing said sheet membrane therein.

11. The masonry tie of claim 10 wherein said sealing device comprises a first, upper member and a second lower member adapted to lock sealingly to each other, fastened upon said tie and sealingly engaging said anchors, each of said first and second members having a channel adapted to receive sheet membrane, and wherein said sealing device further comprises first and second inserts adapted to fit closely within said channels, sealingly securing said sheet membrane therein.

12. A device for sealing pieces of air barrier sheet membrane to a wall having generally horizontal rows of projecting tie anchors in spaced relationship, said device comprising:

an elongate pre-formed member adapted to be mounted to said tie anchors, and having apertures in spaced relationship corresponding to said tie anchors, said apertures being adapted to engage sealingly to a plurality of consecutive tie anchors in such a row of tie anchors, and said members also having surface means extending outwardly from said apertures such that when said member is mounted to said consecutive tie anchors, as in use, said surface means forms a sealed barrier extending above, below and between said consecutive tie anchors, said member comprising first and second portions which mate sealingly together when said member is mounted to said tie anchors, defining said apertures, and said member also having means adapted for sealingly securing the proximal edges of vertically adjacent pieces of said sheet membrane to said surface means, such that when so sealingly secured, as in use, said adjacent pieces of said sheet membrane and said surface means form a continuously sealed air barrier with said consecutive tie anchors sealed thereto and extending outwardly therefrom.

13. The device of claim 12, wherein said member has two parallel channels, each adapted to receive an edge of a piece of sheet membrane, and wherein said member further comprises two inserts adapted to fit within and be retained by said channels, such that in use, the proximal edges of adjacent pieces of sheet membrane may be sealingly secured in said channels by said inserts.

14. The device of claim 13, wherein said first portion of said member has at least one cavity facing said second portion of said member, and said second portion has an element extending outwardly facing said first portion adapted to fit within and be retained by said cavity, such that said first and second portions may be locked sealingly together.

15. A masonry tie for use with an air barrier sheet membrane, comprising:

an elongate frame;

a plurality of anchors projecting transversely outwardly from one side of said frame;

an elongate member extending parallel to said frame, engaged sealingly to at least two consecutive anchors, with said at least two consecutive anchors extending transversely through said member, said member being surface means extending above, below and between said at least two consecutive anchors, and said member also having means adapted for sealingly securing edges of first and second pieces of such sheet membrane to said surface means above and below said at least two consecutive anchors, respectively, such that when so sealingly secured, as in use, said first piece of sheet membrane, said surface means and said second piece of sheet membrane form a continuously sealed air barrier with said at least two anchors sealed thereto and extending outwardly therefrom.

16. The masonry tie of claim 15, wherein said member has first and second parallel channels located respectively above and below said at least two consecutive anchors, each of said channels being adapted to receive an edge of a piece of sheet membrane, and wherein said masonry tie comprises first and second inserts adapted to fit within and be retained by said channels such that in use, edges of two pieces of sheet membrane may be sealingly secured in said channels by said inserts.

17. An air barrier assembly for a wall, for use with sheet membrane, comprising:

(i) at least one masonry tie, comprising an elongate frame and a plurality of anchors projecting outwardly from one side of said frame in spaced relationship; and (ii) at least one sealing device, comprising an elongate pre-formed member adapted to be mounted to said masonry tie, and having apertures in spaced relationship corresponding to said anchors, which aperture are adapted to engage sealingly to at least two consecutive anchors, and surface means extending outwardly from said apertures such that when said member is mounted to said masonry tie, as in use, said surface means forms a sealed barrier extending above, below and between said consecutive anchors, and means adapted for sealingly securing pieces of sheet membrane to said surface means such that when so sealingly secured, as in use, said pieces of sheet membrane and said surface means form a continuously sealed air barrier with said consecutive anchors sealed thereto and extending outwardly therefrom.

18. The air barrier assembly of claim 17, wherein said member of said sealing device comprises first and second portion which mate sealingly together when said member is mounted to said masonry tie, defining said apertures.

19. The air barrier assembly of claim 18, wherein said member of said sealing device has two parallel channels, each adapted to receive an edge of a piece of sheet membrane, and wherein said member further comprises two inserts adapted to fit within and be retained by said channels, such that in use, said pieces of sheet membrane may be sealingly secured in said channels by said inserts.

20. The air barrier assembly of claim 17, further comprising pieces of sheet membrane.

* * * * *